US005716538A

United States Patent [19]

Poloni et al.

[11] Patent Number: 5,716,538

[45] Date of Patent: Feb. 10, 1998

[54] DISCHARGE NOZZLE FOR CONTINUOUS CASTING

[75] Inventors: Alfredo Poloni, Redipuglia; Milorad Pavlicevic; Nuredin Kapaj, both of Udine, all of Italy

[73] Assignee: Danieli & C. Officine Meccaniche SpA, Buttrio, Italy

[21] Appl. No.: 512,627

[22] Filed: Aug. 8, 1995

[30] Foreign Application Priority Data

Aug. 8, 1994 [IT] Italy ..... UD94A0137

[51] Int. Cl.[6] ..... B22D 41/50

[52] U.S. Cl. ..... 222/606; 164/437; 222/594

[58] Field of Search ..... 164/437; 222/606, 222/607, 594

[56] References Cited

U.S. PATENT DOCUMENTS

| | | | |
|---|---|---|---|
| 2,891,291 | 6/1959 | Schnacke | 164/437 X |
| 3,050,792 | 8/1962 | Lipman et al. | 164/437 X |
| 3,669,181 | 6/1972 | Schrewe . | |
| 3,738,419 | 6/1973 | Hartman et al. | 164/437 |
| 5,314,099 | 5/1994 | Butz et al. | 164/437 X |
| 5,402,993 | 4/1995 | Hofmann et al. | 164/437 X |
| 5,429,283 | 7/1995 | Luhrsen et al. | 222/606 |

FOREIGN PATENT DOCUMENTS

| | | | |
|---|---|---|---|
| 0482423 | 4/1992 | European Pat. Off. . | |
| 2243043 | 4/1975 | France . | |
| 3-5049 | 1/1991 | Japan | 222/606 |
| WO89/12519 | 12/1989 | WIPO . | |

OTHER PUBLICATIONS

Abstract of U.S.S.R. Inventor's Certificate 532536 Published Jul. 7, 1984.

*Primary Examiner*—J. Reed Batten, Jr.

*Attorney, Agent, or Firm*—Antonelli, Terry, Stout, & Kraus, LLP

[57] ABSTRACT

The nozzle (10) preferably, but not only, for the production of blooms, billets and conventional, medium and thin slabs, which is suitable to cooperate with a feeder for liquid steel and to discharge that liquid steel into a mould, has a discharge outlet positioned below the meniscus (20). The discharge nozzle (10) includes a first upper intake pipe (11) defining a conduit having a dimension of its cross-section equal to (S) and a nominal diameter (D), the first upper intake pipe (11) being associated at its lower end with a second introduction pipe (12), this second introduction pipe (12) possessing a nominal dimension of its internal passage having a minimum cross-section of 5S in the event of production of blooms, billets or round bars and of 4S in the event of production of conventional, medium and thin slabs. The second introduction pipe (12) comprises at a position in the vicinity of the outlet (14) of the first pipe (11) a divider plate (13) dividing the flow and cooperating with, and defining on its lower side, a flow expansion chamber (15) within the second pipe (12), the flow expansion chamber (15) having a minimum length of 5D in the event of production of blooms and billets and of 10D in the event of production of conventional, medium and thin slabs.

21 Claims, 3 Drawing Sheets

DISCHARGE NOZZLE FOR CONTINUOUS CASTING

BACKGROUND OF THE INVENTION

This invention concerns a discharge nozzle for continuous casting.

The discharge nozzle according to the invention is applied in particular, but not only, to the continuous casting of blooms, billets, round bars, conventional slabs, medium slabs and thin slabs.

In this text the letter "S" shall mean the dimension of the inner cross-section of the first upper intake pipe, while the letter "D" shall mean the nominal inner diameter of the first upper intake pipe.

The field of continuous casting entails problems arising from the turbulence generated in the mould by the liquid steel discharged by the discharge nozzle below the meniscus.

This turbulence, which arises mainly from the high speed of feed of the liquid steel owing to the great flow rates made necessary by the need to ensure high casting speeds, causes great difficulties for the re-ascent of the inclusions to the surface in the mould since these inclusions are drawn away by the turbulence itself.

The liquid steel, owing to its turbulence, takes with it also a part of the covering powders included in the layer above the meniscus, these powders being retained in the skin of the cast product during solidification and thus reducing the quality of that skin.

This situation leads also to the frequent need to re-establish this layer of powders and causes a poor lubrication between the forming skin and the sidewall of the crystalliser.

Moreover, this turbulence causes great problems of the scouring away of the skin of the cast product during the phase of the first formation of that skin at the sides of the crystalliser.

This scouring leads to re-melting of the forming skin and generates disturbances which prevent development of that skin.

So as to overcome these shortcomings partly, steps have been taken to immerse a long segment of the discharge nozzle below the meniscus of liquid metal.

However, if this is done, it not only makes the liquid metal colder in the vicinity of the meniscus with a reduced capacity of melting of the powders but also means that a long vertical segment of the crystalliser is not used.

Discharge nozzles have also been disclosed, especially for the production of thin slabs, which have their bottom closed and have lateral discharge holes facing the narrow sidewalls of the casting chamber.

Discharge nozzles have also been disclosed which have lateral discharge holes with outlets facing upwards and downwards.

These discharge nozzles do not solve fully the problem of the scouring of the sidewalls and they also cause turbulence in the liquid steel at the level of the meniscus, thus accentuating the inclusion of the powders deposited to cover the meniscus.

Moreover, these discharge nozzles with a closed bottom do not ensure a great enough speed of discharge as required for the speed of production of billets or blooms and also of medium and wide slabs.

FR-A-2.243.043 discloses a tubular discharge nozzle having a substantially constant section with lateral discharge holes associated with a containing casing open at its lower and upper sides.

This containing casing includes deviation walls associated with the discharge holes and defining a chamber for the jets of liquid steel running through a free straight segment before being diverted upwards or downwards.

These deviation walls can be conformed according to the zone in which a preferred discharge is to be carried out.

The discharge holes in this discharge nozzle cause an acceleration of the liquid steel, which acquires kinetic energy in the vicinity of the outlet into the mould, and this kinetic energy is only partly dissipated by the impact against the deviation walls.

The liquid steel thus takes on too high outgoing speeds with great problems of turbulence in the pool of liquid steel and with the resulting problems of inclusions and of scouring of the walls.

Moreover, the liquid steel cannot mix freely with the mass of liquid steel contained in the mould, and this situation causes zones of different temperatures.

Furthermore, this embodiment has the effect that the discharge nozzle is immersed in depth in the pool of liquid metal below the meniscus.

U.S. Pat. No. 3,669,181 discloses a discharge means with lateral outlet holes cooperating with means to deflect the liquid steel which converge upwards to define an upper outlet slit, which during normal working does not eliminate the turbulence at the meniscus.

Besides, this slit, owing to its small dimensions, will be readily obstructed by deposits of alumina, with the result that all the liquid steel is deviated downwards; this causes solidification of the meniscus and possible interruption of the casting process since the lubrication powders cannot melt.

Moreover, there is greater scouring of the skin of the metal due to the flow guided along the sides of the mould.

It should be noted that this prior art document includes an upper delivery conduit of small dimensions as compared to the lower part of the discharge means, thereby seemingly reducing the speed of the liquid metal in the lower part.

In actual fact, in view of the kinetic energy possessed by the metal the lower part is, in fact, unimportant and the jet of metal is violently broken up at the bottom and creates great turbulence in the outlet holes.

EP-A-0.482.423 discloses a discharge nozzle which has an at least partly open bottom and which comprises a tubular feeder element having a modest diameter and diverging downwards to form a deceleration chamber for the flow of liquid steel. A divider plate is included immediately before the axial discharge outlet for the liquid steel and blocks the speed of the liquid metal and at the same time splits the flow into two streams, which are directed towards the discharge outlet.

This embodiment not only maintains an excessive discharge speed of the liquid steel into the mould but also increases the turbulence and the formation of whirlpools in the casting chamber with all the unfavourable problems linked thereto.

Furthermore, this discharge nozzle has of necessity to be immersed deeply in the liquid metal below the meniscus.

WO 89/12519 also discloses a feeder tube with a plate to reduce the speed and to divide the flow, this plate being arranged substantially along the whole longitudinal extent of the feeder tube.

This tube suffers substantially from the same shortcomings as EP-A-0.482.423 and especially from the excessive turbulence at the discharge outlet and from the requirement of great immersion.

SUMMARY OF THE INVENTION

The present applicants have designed, tested and embodied this invention on the basis of all the above considerations so as to obviate all the main problems of the discharge nozzles of the state of the art, that is to say, the formation of inclusions, blow holes, internal cracks in the skin, scouring of the sidewalls, etc.

The purpose of the invention is to embody a discharge nozzle for the continuous casting of blooms, billets and conventional, medium and thin slabs, the discharge nozzle being suitable at least to restrict greatly the creation of turbulence and whirlpools in the steel in the mould during the step of discharge of the liquid steel.

In particular, the discharge nozzle according to the invention is conformed in such a way that it can at least reduce considerably the turbulence of the liquid steel and can also reduce considerably the speed of downflow of the liquid steel into the mould, given equal feeding speeds.

The discharge nozzle according to the invention reduces the problems of the scouring of the skin of the bloom/billet/slab during the step of first formation thereof and prevents the problems of engagement and drawing of the powders without causing a decrease of the degree of melting thereof and of the consequent lubrication of the sidewalls of the mould.

Moreover, this discharge nozzle makes possible an increase in the flow of material discharged into the mould and therefore an increase in the casting speed, while ensuring the maintaining of high speeds of production by the continuous casting machine.

A further advantage of the invention consists in the fact that the reduction of turbulence assists the natural re-ascent of the inclusions in the surface and thereby enables the use of devices to be avoided or greatly reduced such as electromagnetic stirrers, which cause this re-ascent of the inclusions in a forced manner.

Furthermore, the discharge nozzle according to the invention is able to be only a little immersed below the meniscus, or to be located at the level of the meniscus or slightly thereabove, together with an improved melting of the powders and an increase of the vertical usable zone of the crystalliser.

At least when the discharge nozzle is located at the level of the meniscus or thereabove, lubricating oil can be used instead of lubricating powders.

The discharge nozzle according to the invention consists of a first tubular intake element having a substantially circular conformation containing an internal passage of a nominal diameter D, or a square or rectangular conformation with an equivalent area of its nominal cross-section.

The first intake pipe is connected at its upper end, by means of standard attachments, to means for discharge of the liquid steel into a mould, such as a tundish or the like.

The first intake pipe is associated at its lower end with a second tubular element having a square, circular or substantially rectangular cross-section mating with, and depending on, the cross-section of the crystalliser, this second tubular element having an area of its cross-section much greater than that of the first intake pipe.

As an example, where billets and blooms are concerned, the area of the cross-section of the second tubular element may be from 5 to 15 times greater than that of the first intake pipe, whereas in the case of conventional, medium and thin slabs that area is at least 4 to 7 times greater.

A divider plate is included in an axial position at a short distance from the outlet of the first intake pipe, that distance having a value between 0.2D and 1D, and has the task of eliminating the linear continuity of the development of the flow within the second pipe, or second tubular element, so as to slow down the speed and to direct the flow into the underlying chamber.

This divider plate has a cross-section coordinated with the cross-section of the internal passage of the second pipe so as to define a free circumferential ring of a substantially constant value.

The divider plate is advantageously secured with spokes to the inner sidewalls of the second pipe and may have a square, circular or rectangular cross-section depending on the inner cross-section of the second pipe and has advantageously a height or thickness of 0.8D to 2D.

If the cross-section is square, the divider plate has sides from 1.2D to 2.2D long, whereas if the cross-section is circular, the divider plate has a diameter from 1.2D to 2.5D.

According to a variant the divider plate extends at its lower end, has its cross-section reduced progressively and takes on a substantially downwards tapered conformation so as to control better the turbulence and the changes of direction of the flow of the liquid steel discharged into the crystalliser.

The lower end of the tapered conformation is widely rounded to control better the turbulence and the changes of direction of the flow of the liquid steel discharged into the crystalliser.

In this case, according to the invention the divider plate takes on a height, or overall thickness, between about 3D and 4D.

If the cross-section is rectangular, the divider plate has a narrower side with a length of 1D to 2.2D and the ratio between the wider side and the narrower side will be about from 1 to 2.2.

The upper surface of the divider plate is advantageously widely rounded to improve the flowing of the liquid steel.

According to a variant, the lower surface too of the divider plate is rounded to enhance the flowing and the formation of fluid streams around that surface in the direction of the underlying expansion chamber.

According to another variant, the cross-section of the divider plate diminishes in the direction of feed of the liquid steel.

The liquid steel below the divider plate flows into the expansion chamber, in which the liquid steel reduces its speed considerably, and therefore its turbulence in proportion to the considerable increase of the cross-section of the internal passage through the chamber.

The expansion chamber possesses an area of a great dimension permitting the liquid steel to expand and therefore to reduce the speed thereof and also possesses a great height, which enables the liquid steel to reduce its turbulence before being discharged into the mould and also to acquire a much more uniform speed and development.

The reduction of the speed of the liquid steel entails a considerable reduction of its kinetic energy, and the impact of the discharged steel against the steel already in the mould is also greatly reduced.

In this way the turbulence and the whirlpools generated in the mould during the step of discharge of the liquid steel are appreciably reduced.

This situation also enables the part of the discharge nozzle immersed below the meniscus to be reduced to a value of about from 1D to 3D.

According to a variant the discharge nozzle is located at the level of the meniscus or slightly thereabove, for instance by a maximum value of about 0.3D to 0.5D.

This greatly reduced value or even a nil value of the immersed part, without thereby creating problems of turbulence at the level of the meniscus, is extremely advantageous inasmuch as it enables a usable part of the mould to be recovered, and thus the overall height can be reduced as a consequence.

Moreover, it is possible to advance the beginning of the formation of the solidified skin with the achievement, at the outlet from the mould, of a greater solidified thickness, given equal casting speeds.

This discharge nozzle can also have the sidewalls of the second tubular element very close to the sidewalls of the mould.

For instance, in the case of thin slabs, the distance of the sidewalls of the discharge nozzle from the sidewalls of the mould has a value of about 0.6D to 1D or for conventional and medium slabs a value of about 0.8D to 2D, whereas for blooms, billets and round bars this value is about 0.6D to 2D.

It is possible to retain intentionally at the outlet from the discharge nozzle a slight turbulence to assist the exchange of the liquid steel held between the sidewalls of the second tubular element and the sidewalls of the mould without thereby causing re-mixing actions at the level of the meniscus.

The height of the second tubular element below the divider plate is at least 5D but may even reach 30D or more where billets, blooms or round bars are being produced.

Where conventional, medium and thin slabs are being produced, this height below the divider plate will have a value of about 10D to 20D.

According to a variant the second tubular element has sidewalls diverging in the downward direction.

According to another variant the sidewalls of the second tubular element include a first upper segment diverging downwards and a second lower straight segment.

According to a further variant the sidewalls of the second tubular element converge in the downward direction.

The value of such convergence or divergence is advantageously not greater than 15°.

According to the invention the outer surface of the discharge nozzle, at least on the part thereof cooperating with the powders, includes a coating jacket to prevent corrosion and wear due to continuous contact with those powders.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
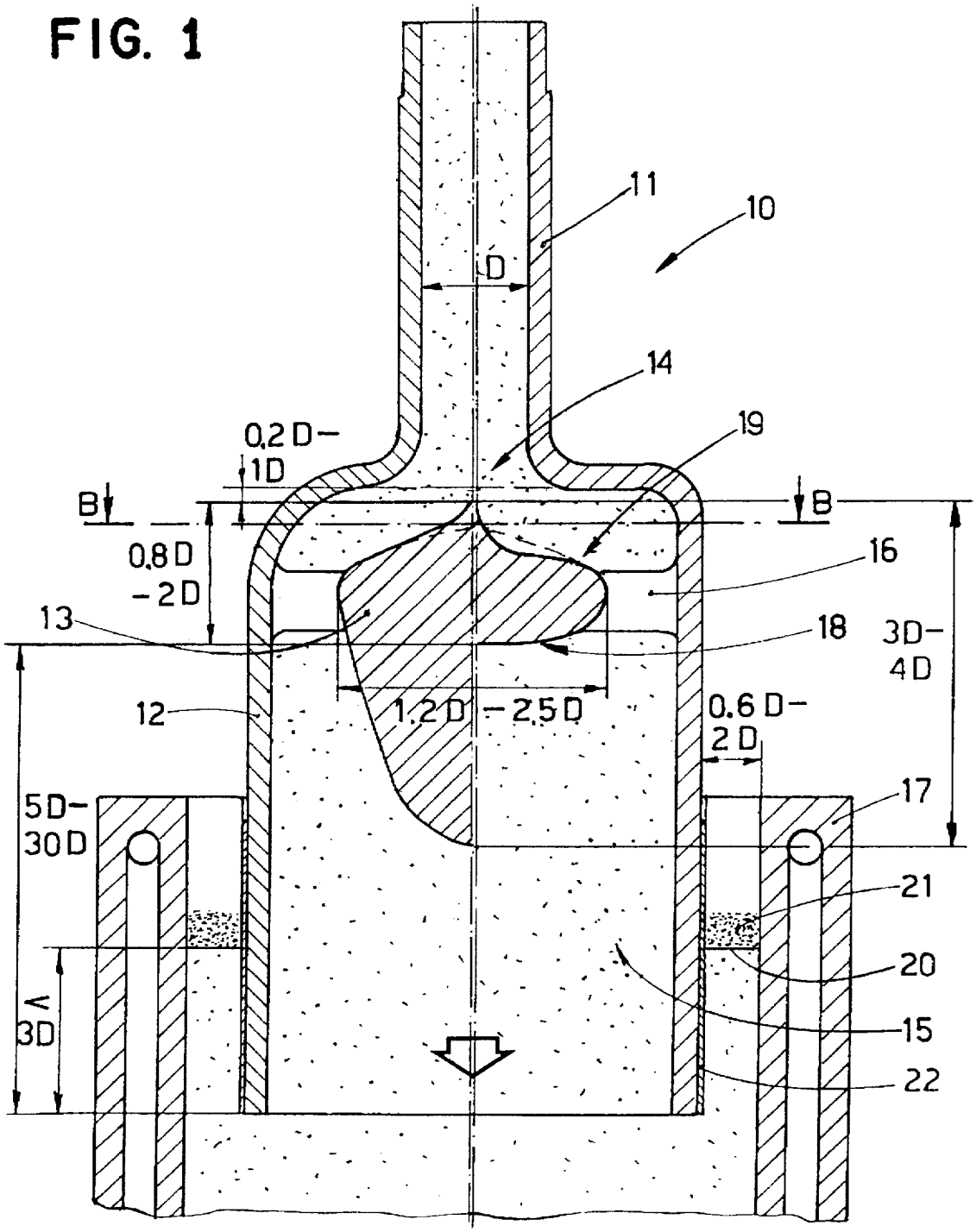
FIG. 1 shows a longitudinal section of the discharge nozzle according to the invention along the line A—A of FIG. 2.
Figure 2:
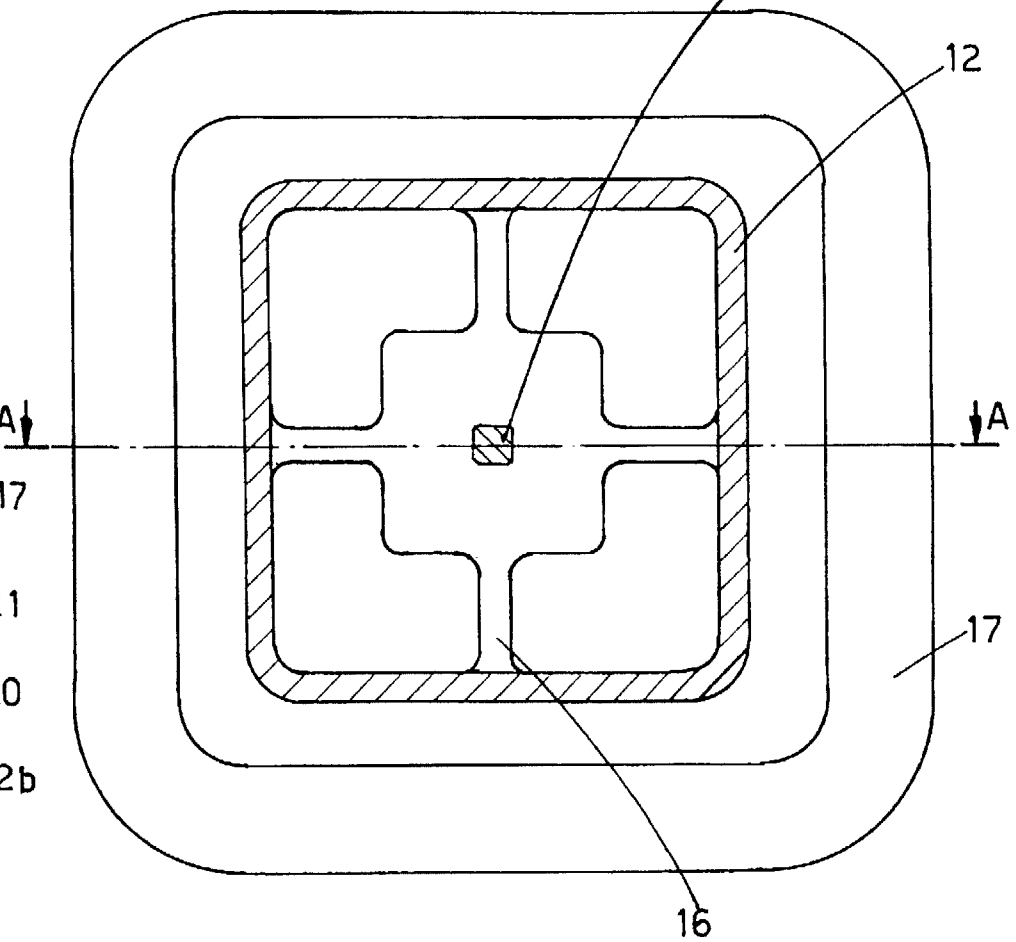
FIG. 2 shows a cross-section of the discharge nozzle of FIG. 1 along the line B—B of FIG. 1.

A discharge nozzle 10 shown in FIG. 1 comprises a first intake pipe 11 having a preferably circular cross-section and, in this case, a constant nominal inner diameter D.

This first intake pipe 11 includes at its upper end an attachment segment of a standard type, depending on the type of casting, for attachment to the means feeding the liquid steel or to a possible extension.

The first intake pipe 11 is connected at its lower end, so as to form one single element, to a second tubular element 12 having a preferably square, circular or rectangular cross-section.

In the example of FIG. 1 two alternative cases are shown, in which the connection on the lefthand side between the first 11 and second 12 tubular elements is widely rounded, whereas the connection on the righthand side is only slightly rounded.

The dimension of the cross-section of the second tubular element 12 is such that, where blooms, billets and round bars are being produced, that cross-section is as much as from 5 to 15 times greater than the cross-section S of the internal passage in the first pipe 11, S in this case being equal to $\pi D^2/4$.

In the event of the production of conventional, medium and thin slabs the cross-section of the second tubular element 12 will advantageously be equal to about from 4S to 7S.

The second tubular element 12 is positioned with its sidewalls located very close to sidewalls 17 of the mould; this distance may be about 0.6D to 1D in the event of production of thin slabs, about 0.8 to 2D for conventional and medium slabs and 0.6D to 2D for billets, blooms and round bars.

A divider plate 13 is included in a central position below the outlet 14 of the first pipe 11 at a minimum distance of about from 0.2D to 1D from that outlet 14 and breaks the continuity of the flow of liquid steel and directs it into an underlying expansion chamber 15.

The divider plate 13 is secured to the sidewalls of the second tubular element, or second pipe 12, in this case by four spokes 16 advantageously for reasons of the symmetry of the cross-section of the passage for the liquid steel.

According to the invention the divider plate 13 has a preferably square, circular or rectangular cross-section and comprises advantageously an upper surface 19 at least slightly tapered and widely rounded to assist the running of the liquid steel to be discharged into the mould.

FIG. 1 shows two alternative possible tapered configurations of the upper surface 19 with a continuous line in the righthand and lefthand parts of the figure respectively, whereas it shows with a line of dashes an alternative less rounded conformation of the upper surface 19 of the divider plate 13.

According to the invention the lower surface 18 of the divider plate 13 has a conformation rounded at its sidewalls so as to assist the running of the fluid streams below the divider plate 13 without disturbances due to sharp changes of direction.

The divider plate 13, when it has a square cross-section, has preferably sides about 1.2D to 2.2.D long, whereas, where the divider plate 13 has a circular cross-section, its diameter will be about 1.2D to 2.5D.

The divider plate 13, where it has a rectangular cross-section, has a narrower side equal to about 1D to 2.2D and a wider side the ratio of which to the narrower side is from about 1 to 2.2.

Figure 3:
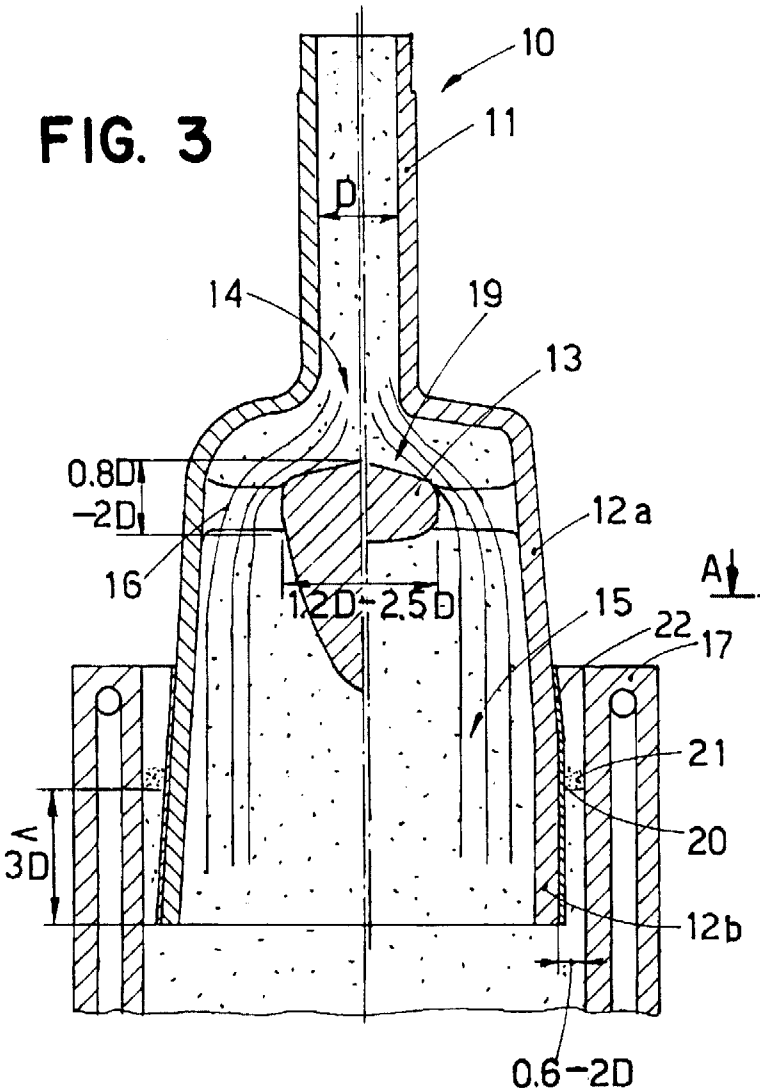
FIG. 3 shows a variant of FIG. 1 in a reduced scale.

The divider plate 13 also has preferably a thickness, or height, of 0.8D to 2D, as can be seen in the righthand part of FIGS. 1 and 3.

In the lefthand part of FIGS. 1 and 3 the divider plate 13 extends downwards to define a substantially tapered conformation facing downwards and widely rounded. In this case the height of the divider plate 13 takes on a value of about 3D to 4D.

This kind of conformation enables the formation of turbulence in the zone immediately below the divider plate 13 to be controlled and the running of the flow of liquid steel to be enhanced towards the lower part of the discharge nozzle 10.

The inclusion of the divider plate 13 splits the flow of liquid steel and reduces its speed and kinetic energy considerably.

The result is that the impact of the steel against the liquid steel already contained in the mould is modest, does not generate those occurrences of turbulence encountered with the discharge nozzles of the state of the art and facilitates the re-ascent of the inclusions to the surface.

This situation has the result that the surface of the meniscus 20 together with the layer of powders 21 thereupon is substantially stable, thus contributing to the improvement of the melting of the powders and therefore to the lubrication of the sidewalls 17 of the mould. This also enables the part of the second pipe 12 of the discharge nozzle 10 positioned above the meniscus 20 to be greatly reduced or to be brought to a nil value, thus reducing the immersed part to a value which in any event is always less than 3D.

When the discharge nozzle 10 is located at the same level as the meniscus 20 or thereabove, lubricating oil can be used instead of powders.

The reduction or elimination of the immersed part entails the advantage of increasing the usable cooling part of the mould and enables the formation of the skin to be started earlier with a resulting greater thickness leaving the mould.

Moreover, this situation ensures a better melting of the powders even where the distance between the sidewalls of the discharge nozzle 10 and the sidewalls of the mould 17 is very modest.

The expansion chamber 15 below the divider plate 13 has a height between 5D and 30D in the event of production of blooms, billets and round bars and between 10D and 20D in the event of production of conventional, medium and thin slabs.

FIG. 3 shows two possible variants of the embodiment of the discharge nozzle 10, which enable the deceleration of the mass of liquid steel discharged into the mould to be further enhanced.

In this case too two alternative embodiments are shown, in which in the lefthand embodiment the second pipe 12 has downwardly diverging sidewalls to determine a relative constant enlargement of the cross-section of the expansion chamber 15 of the discharge nozzle 10, whereas in the righthand embodiment the second pipe 12 has a first upper segment 12*a* diverging downwards and a second lower segment 12*b* with a substantially straight development.

Figure 4:
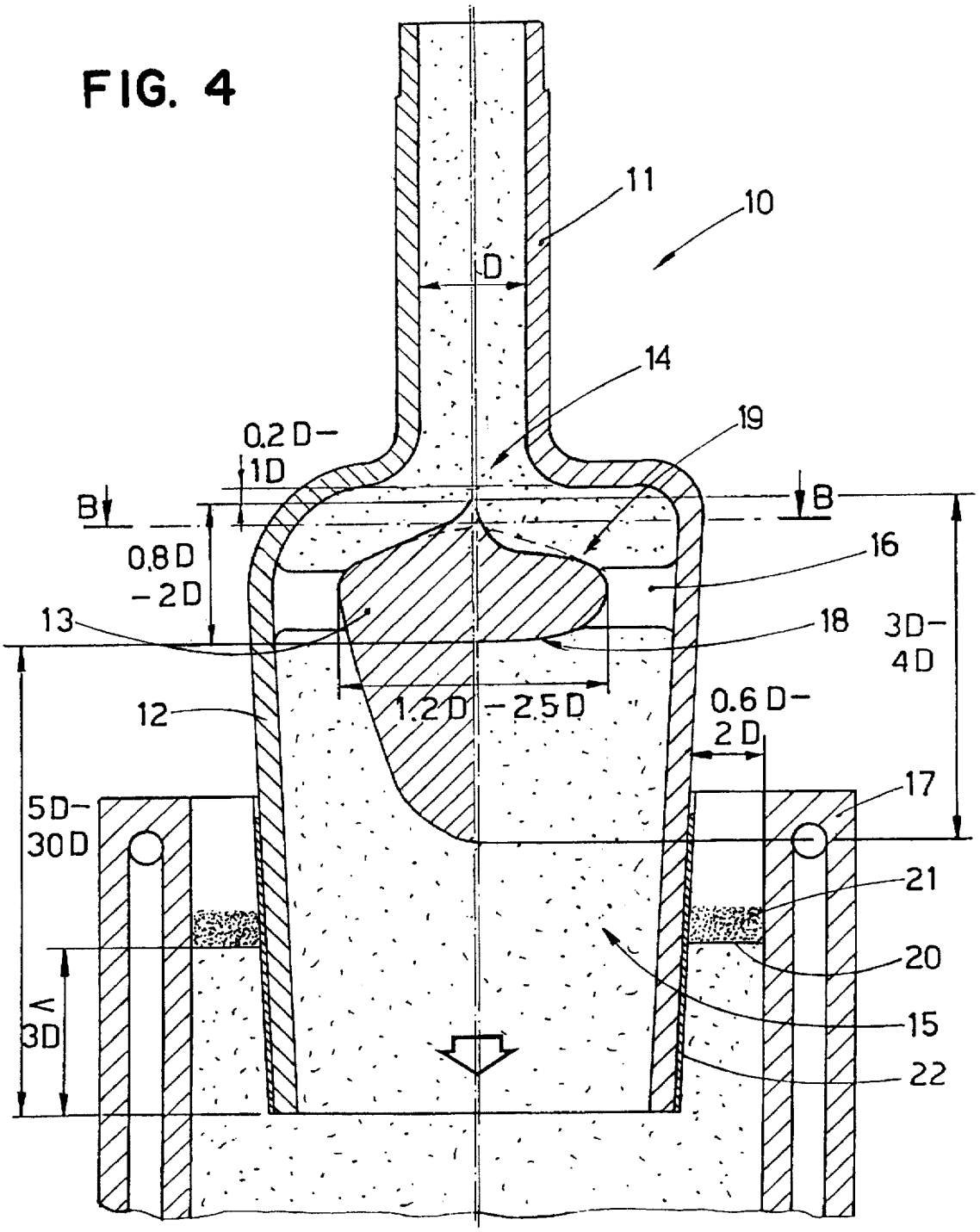
FIG. 4 is a variant of FIG. 1 with the sidewalls of the second pipe coverging downward.

According to a further variant which is shown in FIG. 4, the second pipe 12 has a development with sidewalls converging downwards at least partly.

The angle of the converging/diverging is not greater than 15°.

In this case at least the part of the discharge nozzle 10 cooperating with the powders is coated with a corrosion-resistant jacket 22 so as to reduce wear.

We claim:

1. Discharge nozzle for continuous casting which is suitable to cooperate with a feeder for feeding liquid steel and to discharge that liquid steel into a mould and comprises a first upper intake pipe defining a conduit and having a dimension of its cross-section equal to (S), a nominal diameter (D), an inlet and an outlet; a second introduction pipe provided at the outlet of the first upper intake pipe, the second introduction pipe possessing a nominal dimension of its internal passage having a minimum cross-section of 5S in the event of production of blooms, billets or round bars and of 4S in the event of production of slabs, and having an inlet connected to the outlet of the first upper intake pipe and an outlet; and a divider plate provided in a vicinity of the outlet of the first upper intake pipe for dividing the flow and cooperating with, and defining on its lower side, a flow expansion chamber within the second pipe, the flow expansion chamber extending from the lower side of the divider plate to the outlet of the second introduction pipe, and having a minimum length of 5D in the event of production of blooms and billets and of 10D in the event of production of slabs.

2. Discharge nozzle as in claim 1, in which the second pipe has a nominal dimension of its inner passage with a maximum cross-section of 15S in the event of production of blooms, billets or round bars, and of 7S in the event of production of slabs.

3. Discharge nozzle as in claim 1, in which the flow expansion chamber has a maximum length of 30D in the event of production of blooms, billets or round bars, and of 20D in the event of production of slabs.

4. Discharge nozzle as in claim 1, in which the sidewalls of the second pipe are parallel.

5. Discharge nozzle as in claim 1, in which the sidewalls of the second pipe are downwardly diverging.

6. Discharge nozzle as in claim 1, in which the sidewalls of the second pipe have a first downwardly diverging segment and a second parallel segment.

7. Discharge nozzle as in claim 1, in which the sidewalls of the second pipe converge downwards.

8. Discharge nozzle as in claim 7, in which the angle of converging of the sidewalls of the second pipe has a maximum value of 15°.

9. Discharge nozzle as in claim 1, in which the divider plate has a square cross-section with a side between 1.8D and 2.2D.

10. Discharge nozzle as in claim 1, in which the divider plate has a circular cross-section with a diameter between 1.8D and 2.5D.

11. Discharge nozzle as in any of claim 1, in which the divider plate has a rectangular cross-section the narrower side of which has a value of 1D to 2.2D, whereas the wider side has a value from 1 to 2.2 times the value of the narrower side.

12. Discharge nozzle as in claim 1, in which the divider plate has a thickness (height) having a minimum value of about 0.8D.

13. Discharge nozzle as in claim 1, in which the divider plate has a substantially downwards tapered conformation with rounded corners and extending downwards along the discharge nozzle by a maximum value up to 4D.

14. Discharge nozzle as in claim 1, in which the divider plate is positioned at a minimum distance of about 0.2D to 1D from the outlet of the first pipe.

15. Discharge nozzle as in any claim 1, in which the divider plate has a tapered and rounded upper surface.

16. Discharge nozzle as in claim 1, in which the divider plate has a tapered and rounded lower surface.

17. Discharge nozzle as in claim 1, which has a portion below the meniscus, this portion having a maximum height of at least 3D.

18. Discharge nozzle as in any claim 1, which has its outlet located above the meniscus by a value between 0 and 0.5D.

19. Discharge nozzle as in claim 1, which has at least the lower side of its outer surface associated with a coating jacket having at least a corrosion-resistant function.

20. Discharge nozzle as in claim 6, in which the angle of diverging of the sidewalls of the second pipe has a maximum value of 15°.

21. Discharge nozzle as in claim 5, in which the angle of diverging of the sidewalls of the second pipe has a maximum value of 15°.

* * * * *